United States Patent [19]

Hoffstetter et al.

[11] Patent Number: 4,549,729

[45] Date of Patent: Oct. 29, 1985

[54] OVERLAP CONVEYOR APPARATUS

[75] Inventors: Armand C. L. Hoffstetter, Town & Country, Mo.; Charles K. Cason, Caseyville, Ill.

[73] Assignee: Ga-Vehren Engineering Company, St. Louis, Mo.

[21] Appl. No.: 458,882

[22] Filed: Jan. 18, 1983

[51] Int. Cl.[4] ..... B42B 1/02

[52] U.S. Cl. ..... 270/53; 156/552; 271/151; 271/271; 493/264

[58] Field of Search ..... 270/52–54, 270/57–58; 198/644, 617; 271/225, 243, 280, 281, 271, 184–186, 196, 216, 150–151, 202, 204; 156/552; 493/264, 267, 335

[56] References Cited

U.S. PATENT DOCUMENTS

| | | | |
|---|---|---|---|
| 2,363,417 | 11/1944 | Heywood | 493/335 |
| 3,122,362 | 2/1964 | Vollrath et al. | 271/204 |
| 3,200,719 | 8/1965 | Welch | 270/53 |
| 3,572,682 | 3/1971 | Leach | 270/52 |
| 3,671,035 | 6/1972 | Reist | 271/204 |
| 3,719,267 | 3/1973 | Reist et al. | 271/202 X |
| 3,721,435 | 3/1973 | Zanders | 270/52 |
| 3,741,085 | 6/1973 | Sutton | 493/264 |
| 3,799,044 | 3/1974 | Manolis | 493/335 |
| 3,937,452 | 2/1976 | Gath | 270/52 |
| 4,072,228 | 2/1978 | Honegger et al. | 271/202 |
| 4,333,559 | 6/1982 | Reist | 271/204 X |
| 4,334,672 | 6/1982 | Felix | 270/53 |
| 4,373,986 | 2/1983 | Cone | 270/58 X |

FOREIGN PATENT DOCUMENTS

| | | | |
|---|---|---|---|
| 2072631 | 10/1981 | United Kingdom | 270/54 |
| 2089328 | 6/1982 | United Kingdom | 270/58 |

*Primary Examiner*—E. H. Eickholt

*Attorney, Agent, or Firm*—Cohn, Powell & Hind

[57] ABSTRACT

This conveyor apparatus is used primarily with continuous business form processing machines to provide a means of producing a stream of overlapped blanks disposed on a continuous web. The apparatus includes upper and lower conveyors. The upper conveyor is formed from a pair of endless flexible elements having transversely aligned wedge-shaped pins disposed along the length thereof with inclined trailing flanks. Document blanks are fed onto the upper conveyor such that the leading edge rides up and beyond an aligned pair of associated pins an the trailing edge is engaged by a pair of following pins. Each of the blanks is pushed by a pair of transversely aligned pins in overlapped relation to the preceding blank. The document blanks are removed from the upper conveyor and deposited in reverse overlap relation onto gum lines provided on the continuous web carried by the lower conveyor.

9 Claims, 6 Drawing Figures

OVERLAP CONVEYOR APPARATUS

BACKGROUND OF THE INVENTION

This invention relates generally to continuous web business processing machines and particularly to a conveyor apparatus forming an integral part of such a machine which provides that document blanks are sequentially deposited on the continuous web in an overlapped relation.

Continuous web business processing machines of the type under consideration commonly produce a combination product which consists of the web having document blanks attached thereto. The blanks frequently require further processing in the nature of printing for example and it is a considerable advantage to provide that such blanks are overlapped with respect to each other so that they can be fed as a continuous stream into a printing machine in such a way that each blank tends to hold the following blank in place and thereby avoid disengagement, tearing and other problems to which the blanks would otherwise be subject as they are passed between rollers and other mechanisms. In addition the overlap condition tends to render the web, blank combination easier to package and store.

Conveyor apparatus which provides this overlap alignment are known and one such apparatus is disclosed in U.S. Pat. No. 4,270,967. In this apparatus an angled overhead conveyor rack assembly is used in combination with a bottom conveyor assembly, the combination being disposed between a feeder such as a Halm Jet rotary vacuum feeder and a compression station. The bottom conveyor is provided with longitudinally spaced stops at intervals shorter than the length of the blanks. The leading edge of the document blank is intercepted by one of the stops and the trailing end is raised by a succeeding stop in cooperation with the overhead conveyor rack which applies a downward force onto the document blank as the document blank moves toward the compression station. The operation of this overlap device and particularly the aligned forward movement of the blank depends upon the use of the overhead rack which is a somewhat complicated and therefore expensive device.

Another apparatus which provides for the staggering of blanks of sheet material is disclosed in U.S. Pat. No. 3,672,667. This patent discloses the use of an endless conveyor having a wedge cam element on the outer surface. The cam is provided with an inclined leading flank and a trailing flank. Blanks fed onto the conveyor impinge against the trailing flank and the blanks are held onto the conveyor by suction during travel. The leading edge of the cam raises preceding blanks to permit following blanks to be received under said preceding blanks by virtue of the reduced exit speed of the blanks. A carrier sheet business form assembly having overlapping blanks is shown in U.S. Pat. No. 4,091,987 and is standard in the industry.

SUMMARY OF THE INVENTION

This conveyor apparatus is used in connection with a continuous web business processing machine to provide accurate, overlapping alignment of blanks deposited on the continuous web at high speed.

The conveyor apparatus includes a first endless, flexible conveyor having at least one endless flexible element and having upper and lower spans, said element providing a plurality of pins having a leading flank and an inclined trailing flank, a second conveyor carrying the elongated web; blank feed means at the upstream end of the first conveyor for depositing blanks onto said upper span of said conveyor with the leading end of the blank extending beyond the leading flank of the pin and being disposed in overlapping relation above the trailing end of the preceeding blank, and blank takeoff means at the downstream end of the first conveyor for removing blanks from the upper stand of said conveyor and depositing said blanks onto the web carried by the second conveyor with the leading end of the blank being disposed in underlapping relation below the tailing end of the preceeding blank and in contact with a gum line of the web.

In one aspect of the invention the first conveyor includes a pair of flexible elements disposed in side-by-side relation, the pins on one element being transversely aligned with the pins on the other element.

It is an aspect of this invention to provide blank feed means depositing blanks onto the upper span of the first conveyor at a surface speed at least as great as the surface speed of the upper span to facilitate engagement of the trailing edge of the blank against the leading flank of the following pin.

It is another aspect of this invention to provide blank takeoff means removing blanks from the upper stand of the first conveyor at a surface speed at least as great as the surface speed of the upper stand to avoid continuous engagement between the trailing edge of a blank and the leading flank of the following pin.

It is yet another aspect of this invention to provide that the first conveyor includes brush means for retarding the speed of the blanks deposited on said conveyor upper span to facilitate engagement between the trailing edge of a blank and the leading flank of the following pin.

Still another aspect of this invention is to provide that the endless flexible elements of the first conveyor are chains, having lugs attached thereto at intervals along the length thereof for mounting the pins.

It is another aspect of this invention to provide pins which are recessed on the trailing flank and include an elongate slotted opening to the mid-lengthwise adjustment of the pins relative to the direction of movement of the chain.

Still another aspect of this invention is to provide pins which are substantially wedge-shaped having a leading flank substantially perpendicularlly disposed to the direction of travel of the flexible elements of the upper conveyor.

Yet another aspect of this invention is to provide pins which are selectively removable to vary the spacing between said pins to suit selected blank sizes.

Yet another aspect of this invention is to provide a method of overlapping blanks deposited from a feed device onto an endless conveyor comprising the steps of delivering blanks onto the conveyor upper span at equal time intervals; raising the leading end of the blank relative to the trailing end at the point spaced rearwardly from the leading edge thereof above the trailing end of a preceeding blank; engaging the relatively low trailing end of the blank and pushing the blank at the speed of the conveyor and maintaining the blank in an overlap condition during travel of the blank for substantially the length of the conveyor.

DESCRIPTION OF THE PREFERRED EMBODIMENT

Figure 1:
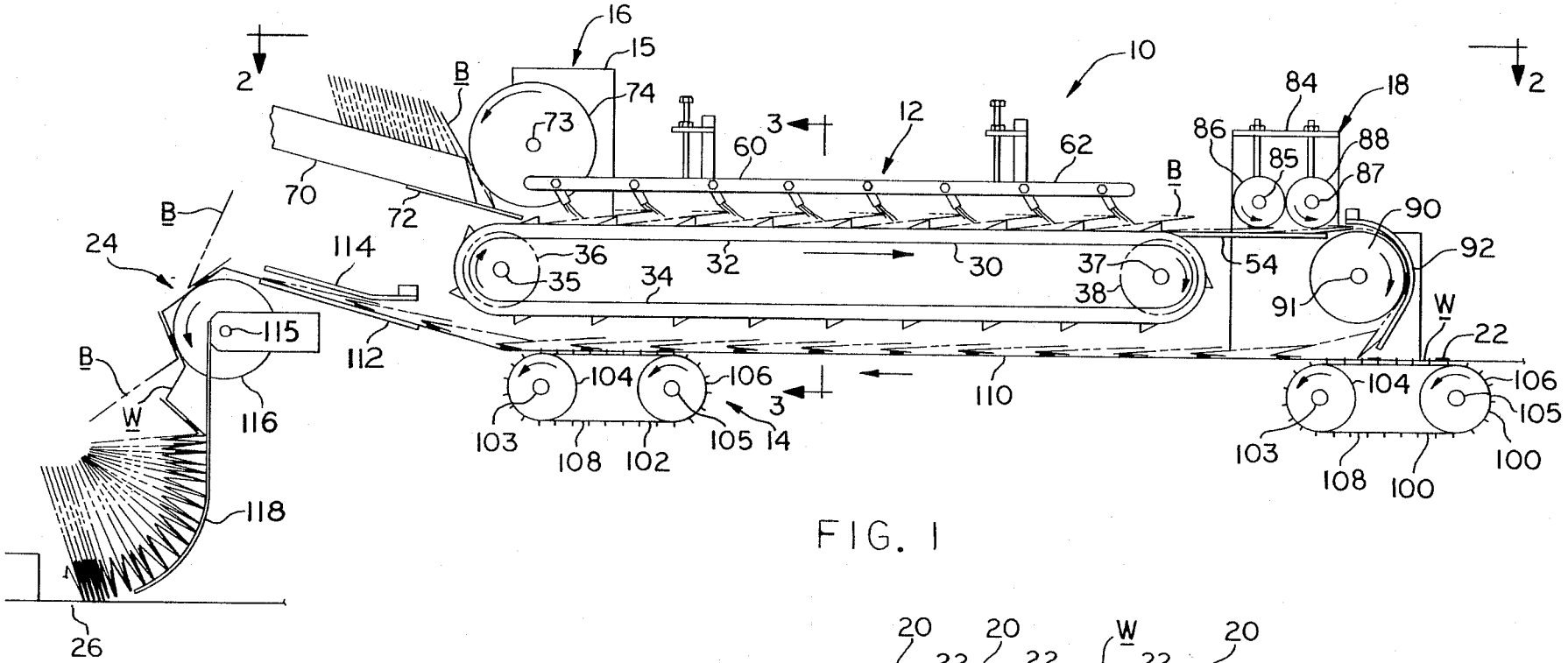
FIG. 1 is a generally schematic side elevational view of the conveyor apparatus.
Figure 2:
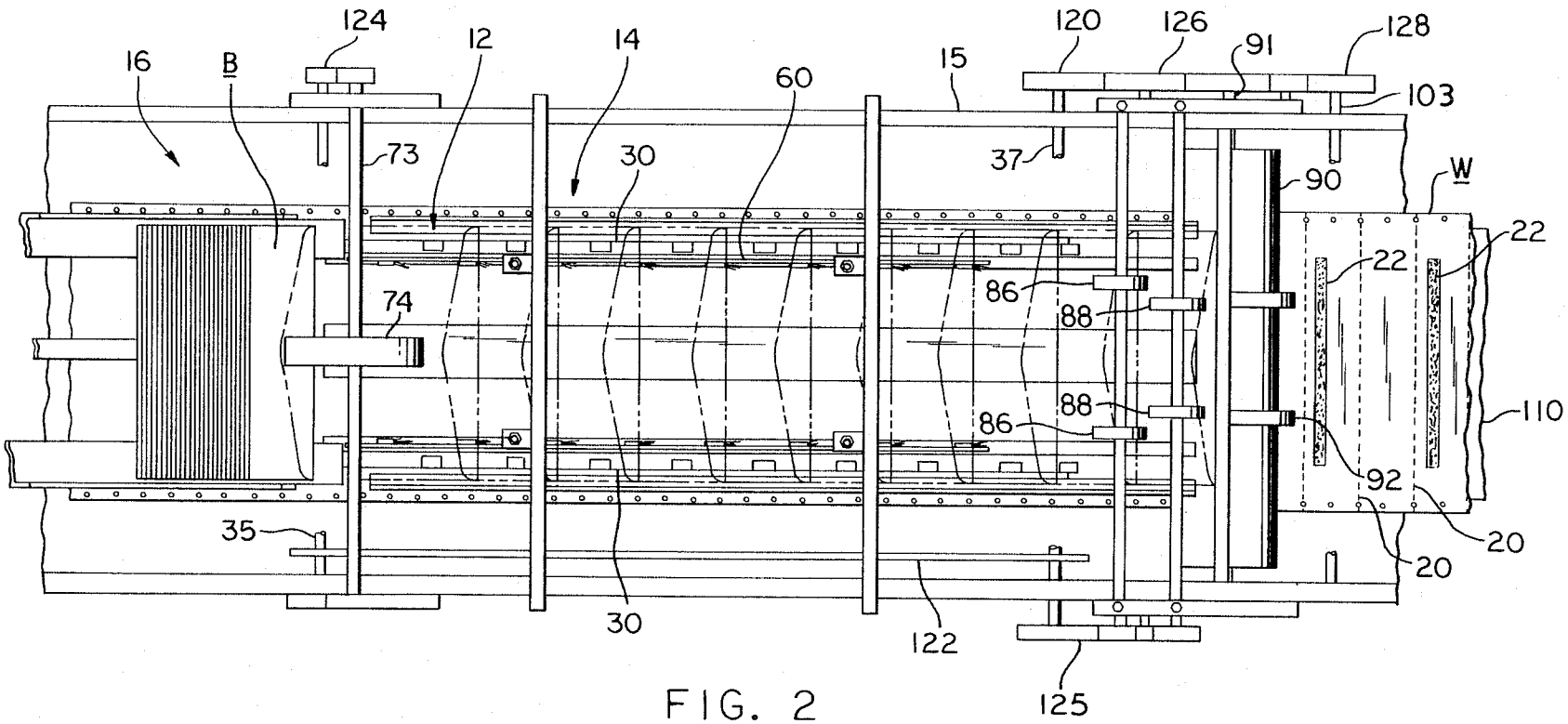
FIG. 2 is a plan view on line 2—2 of FIG. 1.

Referring now by reference numerals to the drawings and first to FIGS. 1 and 2 it will be understood that the conveyor apparatus generally indicated by numeral 10 forms an integral part of a business form machine of the type used for processing an elongate web W and depositing document blanks B such as envelopes at intervals along said web.

Figure 5:
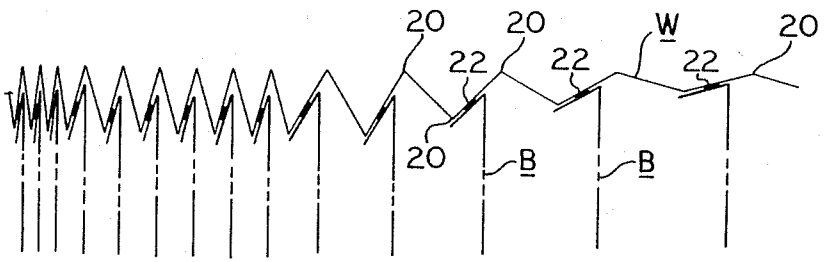
FIG. 5 is a schematic illustrating an end product of the conveyor apparatus.

The conveyor apparatus 10 consists essentially of an upper conveyor 12 and a lower conveyor 14, constituting first and second conveyors respectively, both mounted to a side support structure generally indicated by numeral 15 and similar to the support structure shown in U.S. Pat. No. 4,249,984 and U.S. Pat. No. 4,257,514. A feed means for projecting a continuous stream of blanks B onto the upper conveyor and generally indicated by 16, is disposed at the upstream end of the upper conveyor 12, a blank take-off means generally indicated by 18 is disposed at the downstream end of the upper conveyor 12 for removing blanks from the upper conveyor and depositing said blanks onto the perforated carrier web W carried by the lower conveyor 14. The web includes transverse fold lines 20, as shown in FIG. 5 and transverse gum lines 22 are disposed intermediate alternate pairs of fold lines 20 on the upper side of said web, said gum lines being applied at equal intervals along the length of the web W at a gumming station (not shown) disposed upstream of the lower conveyor 14. The web and blank combination is collected at a fan folding station 24 disposed at the downstream end of the lower conveyor 14 and collected at a collecting station 26. Alternatively, the web and blank combination can be collected in rolls.

Figure 6:
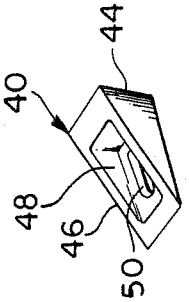
FIG. 6 is an enlarged perspective view of a wedge-shaped pin.

Referring now more specifically to the component parts of the upper conveyor 12 and with particular reference to FIGS. 1, 2, 3, and 4 it will be understood that said conveyor includes at least one and preferably a pair of transversely spaced chains 30, constituting endless flexible elements and providing upper and lower spans 32 and 34 which travel around upstream and downstream rotatable sprocket elements 36 and 38. Sprocket elements 36 are mounted on an idler shaft 35 and sprocket elements 38 are mounted on a drive shaft 37, said shafts 35 and 37 being carried by the support frame 15. Shaft 37 is connected to a drive means generally indicated by 120 and a chain drive 122 interconnects shafts 35 and 37 as shown in FIG. 2. Importantly, chains 30 carry a plurality of generally wedge-shaped pins 40 disposed at equally spaced intervals along the length of the chains and attached to said chains as by L-shaped lugs 42. As shown in FIG. 6, the pins 40 include, relative to the direction of motion of the upper span, a perpendicular leading flank 44 and an inclined trailing flank 46. In the embodiment shown in FIG. 6, each pin 40 includes a recess 48 and an elongate bottom opening 50 and said pin 40 is attached to said lug 42 as by a removable fastener 52. In the embodiment shown the blanks are envelopes but the apparatus can readily be modified to suit longer blanks such as letterheads by simply removing selected pins 42.

Figure 3:
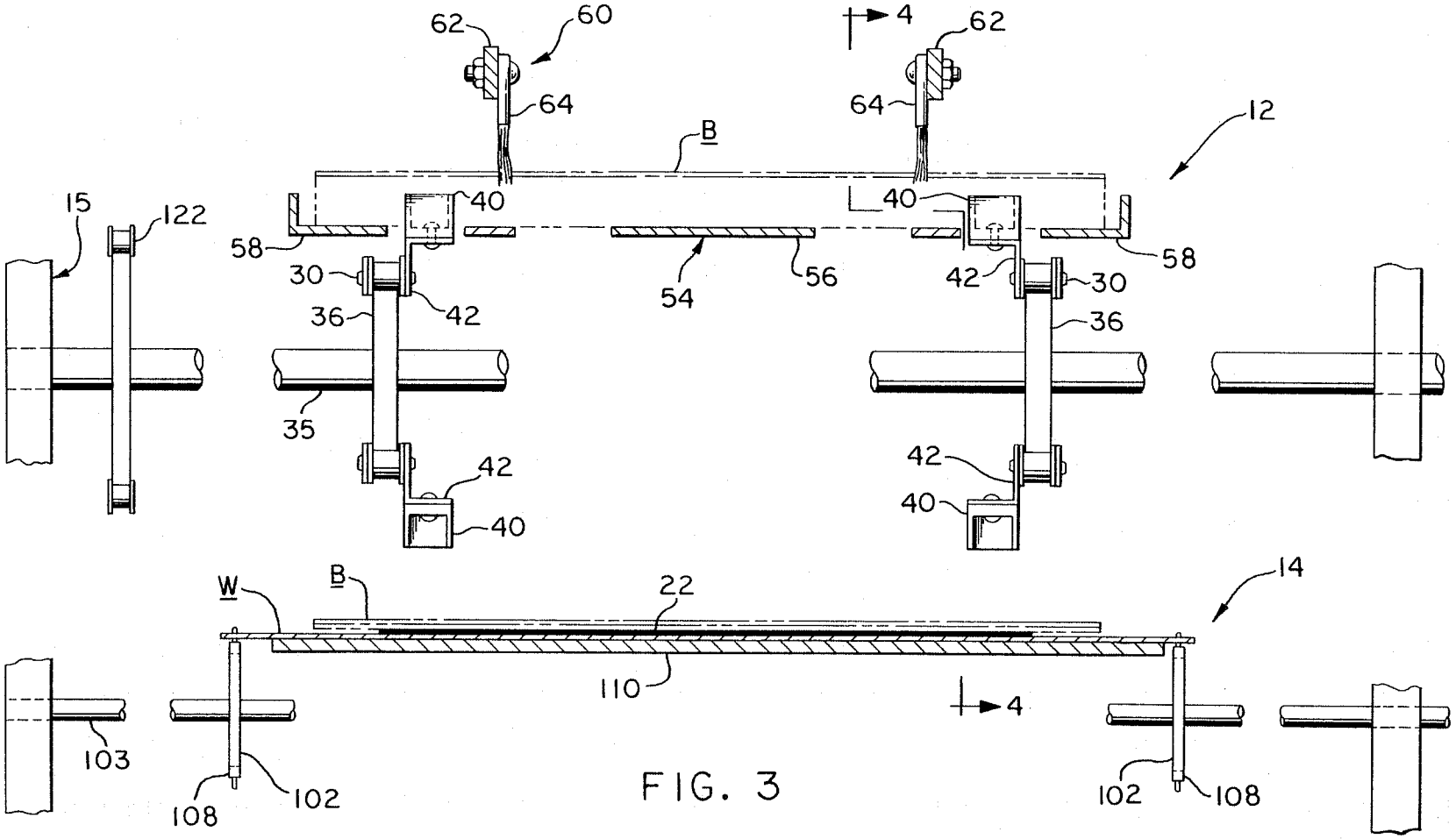
FIG. 3 is an enlarged cross sectional view taken on line 3—3 of FIG. 1.
Figure 4:
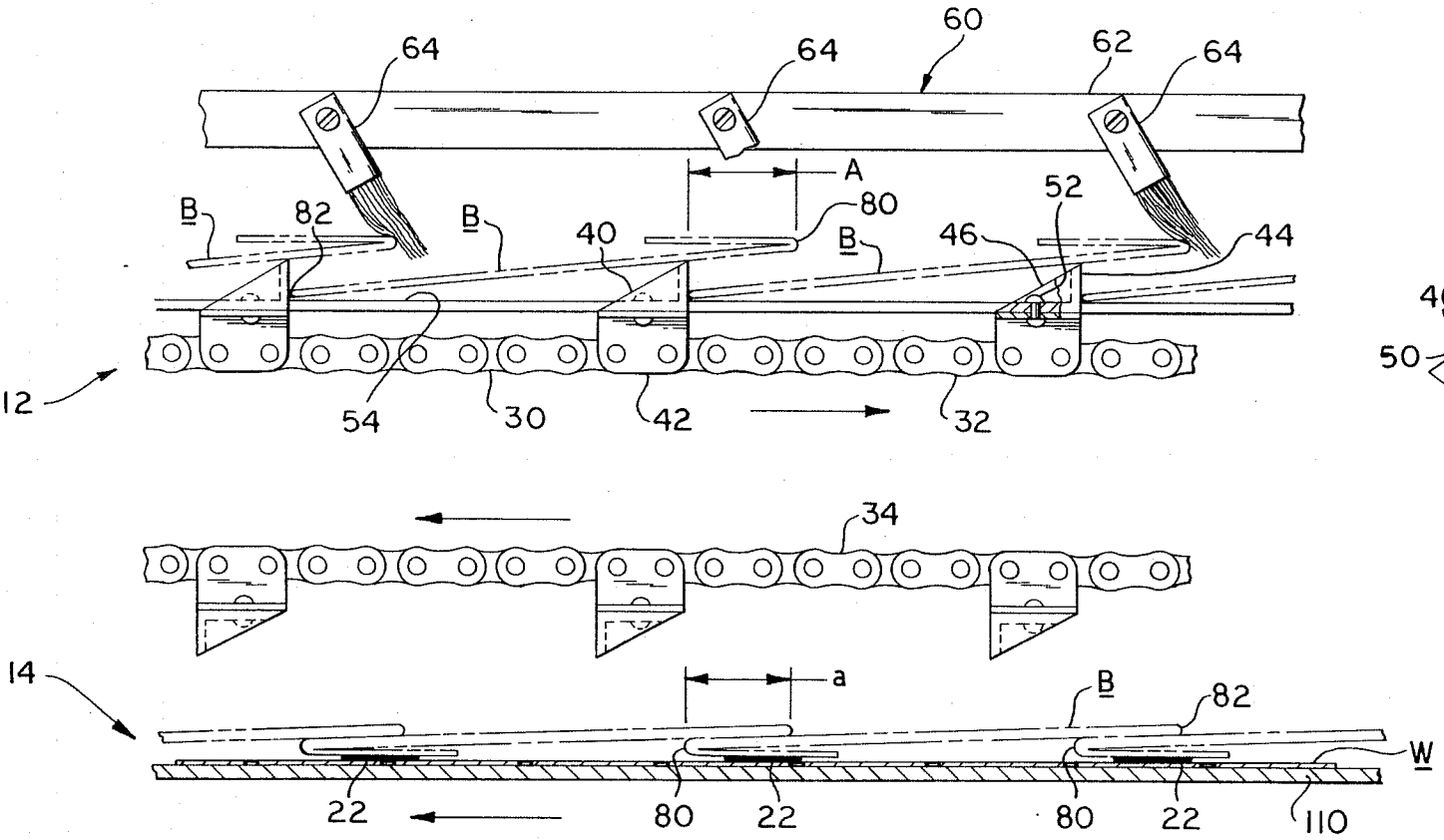
FIG. 4 is a fragmentary sectional view taken on line 4—4 of FIG. 3.

As shown in FIG. 3 the chains 30 are disposed between intermediate and side portions 56 and 58 respectively of a table assembly 54, the side portions 58 being slotted to receive the pins 40. The upper surface of said table 54 is disposed slightly above the lowest portion of the pin inclined flank 46 so that, as shown in FIG. 4, the inclined flank presents no obstacle to movement of a blank B received by said table surface. The upper conveyor 12 also includes a super adjacent brush assembly 60 providing opposed support arms 62 each carrying a plurality of brush elements 64 depending therefrom in angled relation.

The feed device 16 at the upstream end of the upper conveyor 12 includes a supply tray 70 carrying a stack of blanks B and having a forward lip 72 and a feed wheel 74 mounted to a shaft 73 carried by the support frame 15 and being engageable with the blanks B to transfer said blanks from said tray 70 onto the table assembly 54. In the embodiment shown, the feed wheel 74 is connected to the shaft 35 through a drive means generally indicated by numeral 124. The circumferential surface speed of the feed wheel 74 relative to the linear speed of the conveyor upper span 32 and the longitudinal spacing of the pins 40 relative to the length of the blank B are such that the leading edge 82 of the blank B slides up the inclined flank 46 while the trailing edge 84 of said blank engages the upright flank 44 of the following pin. In the embodiment shown, the brushes 64 provide the necessary retarding effect to facilitate this action. The disposition of the pins 40 as described provides that the blanks B are deposited on the conveyor upper span 32 with the leading end of the blank extending beyond the leading flank of the pins 40 and being disposed in overlaping relation above the trailing end of the preceding blank.

As shown in FIG. 1 the blanks B are carried by the conveyor upper span 30 in a generally horizontal condition into the vicinity of the take-off means 18. The leading edge 80 of the blank B is engaged and carried forwardly by a disc assembly 84 consisting of spaced pairs of discs 86 and 88 mounted to shafts 85 and 87 respectively, carried by the support frame 15. Disc assembly 84 is disposed upstream of a vacuum drum 90. The drum 90 is mounted to a shaft 89 carried by the support frame 15 and forms part of the take-off means, and continues the movement of the blanks through a reverse turn guided by a curved guide assembly 92 to deposit blanks B onto the web W carried by the lower conveyor 14. As best shown in FIGS. 1, 3 and 4 the lower conveyor 14 is of the pin chain type consisting of upstream and downstream pin chain units 100 and 102 disposed adjacent a table plate 110 carrying the web W. Pin chain units 100 and 102 include drive and idler sprockets 104 and 106 mounted to shafts 103 and 105 respectively carried by the side frame 15 and pin chains 108, which engage the perforations of the web W to transport the web W along the plate 110.

The disc assembly shafts 87 and 89 and the shaft 91 vacuum drum are operatively connected to the drive shaft 37 by drive means indicated by 125 and 126 respectively. The drive shaft 103 of the pin chain units 100 is operatively connected to shaft 37 by drive means indicated by 128 and the drive shafts 103 of the two pin chain units 100 and 102 are operatively connected together by a chain assembly (not shown). The vacuum drum 90 deposits the blanks B onto the web W in an upside down condition such that the face of the blanks which was uppermost during travel along the upper span 32 of the upper conveyor 12 becomes the lowermost face. Consequently, the blank B is deposited on the web W carried by the lower conveyor 16 with the leading end disposed in underlapping relation below the trailing end of the preceding blank and in contact with one of the gum lines 22 provided at spaced intervals along the length of the web W as clearly shown in FIG. 4. The circumferential surface speeds of the discs 86 and 88 and the vacuum drum 90, relative to the linear speed of the lower conveyor are such that the overlap of the blanks B is maintained. This is shown in FIG. 4 in which overlap "A" on the upper conveyor 12 is substantially equal to overlap "a" in the lower conveyor 14.

In the preferred embodiment the linear speed of the web W as determined by the lower conveyor 14 can be considered as a reference speed. The linear speed of the upper conveyor 12 which carries the blanks is substantially equal to the speed of the web W. However, the circumferential surface speed of the feed wheel 74 is preferably in excess of the speed of the upper conveyor 12 to facilitate accurate placement of the blanks B on said upper conveyor. The circumferential surface speed of the take-off discs 86 and 88 is also greater than the speed of the upper conveyor so that the pins 40 do not catch the trailing edge of the blanks B as the pins turn around sprocket 38. The circumferential surface speed of the vacuum drum 90 is substantially the same as the linear speed of the web W so that there is a minimum of differential movement when the blanks are disposed on the web.

The fan-folding take-off means 24 disposed adjacent the downstream end of the lower conveyor 14 includes a receiving table plate 112 and guide plate 114 which direct the combined web W and blanks B into the vicinity of a vacuum wheel assembly 116 mounted to a shaft 115 carried by the support frame 15. The wheel assembly fan-folds the combined web and blank and deposits the fan-folded combination by way of a guide plate 118 to the collection station 26. Although fan-folding is convenient for packaging the combination web and blanks can be stored in a roll if desired.

In the embodiment shown, the contour of the inclination of the trailing flank 46 of the pins 40 is straight. However, the contour of the trailing flank can be varied so long as the height of the pin 40 which projects above the lapped blank is at least as great as the thickness of the blank material.

When it is desired to vary the spacing of the pins 40 to suit a different blank it is simply a matter of removing selected pins to increase the spacing to two or three times the spacing between the pins. The extent of the overlap is not critical so long as it is sufficient to prevent unlapping and therefore fine adjustment of pin spacing is not essential. However, the pins are lengthwise adjustable to compensate for chain stretching.

We claim as our invention:

1. A conveyor apparatus for use in a business form machine of the type used for processing an elongate web having transverse gum lines, the apparatus depositing blanks onto said web in overlapping relation to each other, the apparatus comprising:

(a) a first conveyor including at least one endless flexible element and having upper and lower spans, said element having a plurality of pins disposed at spaced intervals along the length thereof, said pins having an inclined flank receiving the leading end of the blank and another flank engageable with the trailing end of the blank in pushing relation, said flanks being generally fixed relative to the direction of travel of the flexible element of the upper conveyor, (b) a second conveyor carrying the elongate web, (c) blank feed means at the upstream end of the first conveyor for depositing blanks onto said upper span of said conveyor with the leading end of the blank extending beyond the leading flank of a pin and being disposed in overlapping relation above the trailing end of the preceding blank, and (d) blank take off means at the downstream end of the first conveyor for removing blanks from the upper span of said conveyor and depositing said blanks onto the web carried by the second conveyor with the leading end of the blank being disposed in underlapping relation below the trailing end of the preceding blank and in contact with a gum line of the web.

2. A conveyor apparatus as defined in claim 1, in which:

(e) the first conveyor provides a pair of endless flexible elements disposed in side-by-side relation, the pins on one element being transversely aligned with the pins on the other element.

3. A conveyor apparatus as defined in claim 1, in which:

(e) the blank feed means deposits blanks onto the upper span of the first conveyor at a surface speed at least as great as the surface speed of said upper span to facilitate engagement of the trailing end of the blank against said other flank of the following pin.

4. A conveyor apparatus as defined in claim 1, in which:

(e) the blank take off means removes blanks from the upper span of the first conveyor at a surface speed at least as great as the surface speed of said upper span to avoid continuous engagement between the trailing edge of a blank and said other flank of the following pin as the pin rotates with said endless flexible element.

5. A conveyor apparatus as defined in claim 1, in which:

(e) the pins are substantially wedge shaped, and (f) the endless flexible element of the first conveyor is a chain having lugs attached thereto at equal intervals along the length thereof for mounting the wedge-shaped pins.

6. A conveyor apparatus as defined in claim 1, in which:

(e) the pins are substantially wedge shaped having a leading flank substantially perpendicularly disposed to the direction of travel of the flexible elements of the upper conveyor.

7. A conveyor apparatus as defined in claim 5, in which:

(f) the pins are selectively removable to vary the spacing to suit selected blank sizes.

8. A conveyor apparatus for use in a business form machine of the type used for processing an elongate web having transverse gum lines, the apparatus depositing blanks onto said web in overlapping relation to each other, the apparatus comprising:

(a) a first conveyor including at least one endless flexible element and having upper and lower spans, said element having a plurality of pins disposed at spaced intervals along the length thereof, said pins having a leading flank and a trailing flank, (b) a second conveyor carrying the elongate web, (c) blank feed means at the upstream end of the first conveyor for depositing blanks onto said upper span of said conveyor with the leading end of the blank extending beyond the leading flank of a pin and being disposed in overlapping relation above the trailing end of the preceding blank, (d) blank take off means at the downstream end of the first conveyor for removing blanks from the upper span of said conveyor and depositing said blanks onto the web carried by the second conveyor with the leading end of the blank being disposed in underlapping relation below the trailing end of the preceding blank and in contact with a gum line of the web, and (e) the endless flexible element of the first conveyor being a chain having lugs attached thereto at equal intervals along the length thereof for mounting the pins, and (f) the pins being recessed on the trailing flank and including an elongate slotted opening to permit lengthwise adjustment relative to the direction of movement of the chain.

9. In a conveyor apparatus for use in a business form machine of the type used for processing an elongate web having transverse gum lines, the apparatus being of the type having an upper conveyor carrying blanks for depositing onto a lower conveyor carrying the gummed web, the upper conveyor including the improvement of an endless flexible element having a plurality of wedge shaped pins mounted thereto said pins having a leading flank and an inclined trailing flank said inclined trailing flank receiving the leading end of the blank and said leading flank being engageable with the trailing end of the blank in pushing relation, said flanks being generally fixed relative to the direction of travel of the flexible element of the upper conveyor, said pins being longitudinally spaced at intervals less than the length of the blank so that the leading end of a blank is raised in overlapping relation above the trailing end of the preceding blank.

* * * * *